US011405994B2

(12) United States Patent
Gao et al.

(10) Patent No.: US 11,405,994 B2
(45) Date of Patent: Aug. 2, 2022

(54) CCT SWITCHABLE ILLUMINATING DEVICE

(71) Applicant: SAVANT TECHNOLOGIES LLC, East Cleveland, OH (US)

(72) Inventors: Jie Gao, Shanghai (CN); Pan Yao, Shanghai (CN); Zhe Wang, Shanghai (CN)

(73) Assignee: SAVANT TECHNOLOGIES LLC, East Cleveland, OH (US)

( * ) Notice: Subject to any disclaimer, the term of this patent is extended or adjusted under 35 U.S.C. 154(b) by 0 days.

(21) Appl. No.: 17/365,562

(22) Filed: Jul. 1, 2021

(65) Prior Publication Data

US 2022/0030682 A1 Jan. 27, 2022

(30) Foreign Application Priority Data

Jul. 27, 2020 (CN) ..... 202021505560.X

(51) Int. Cl.

| | |
|---|---|
| ***H05B 45/10*** | (2020.01) |
| ***F21K 9/23*** | (2016.01) |
| ***H05B 45/20*** | (2020.01) |
| ***F21K 9/232*** | (2016.01) |
| ***H05B 45/46*** | (2020.01) |

(Continued)

(52) U.S. Cl.

CPC ..... *H05B 45/20* (2020.01); *F21K 9/232* (2016.08); *F21K 9/238* (2016.08); *H05B 45/10* (2020.01); *H05B 45/345* (2020.01); *H05B 45/46* (2020.01)

(58) Field of Classification Search

CPC ..... H05B 45/00; H05B 45/10; H05B 45/20; H05B 45/345; H05B 45/46; F21K 9/232; F21K 9/238

See application file for complete search history.

(56) References Cited

U.S. PATENT DOCUMENTS 10,234,091 B1 * 3/2019 Chaimberg ..... F21V 17/162

* cited by examiner

*Primary Examiner* — Jimmy T Vu

(74) *Attorney, Agent, or Firm* — Wood IP LLC

(57) ABSTRACT

Provided is a switchable Correlated Color Temperature (CCT) illuminating device. The device may include a CCT switching unit, forming electrical connection with a drive power source, and a bulb shell, at least one filament being arranged inside the bulb shell, the filament including a substrate, and a first light-emitting unit group and a second light-emitting unit group arranged on the substrate and forming electrical connection with the CCT switching unit. Each of the first light-emitting unit group and the second light-emitting unit group comprises one or more light-emitting unit, the first light-emitting unit group and the second light-emitting unit group are connected in parallel and conducting directions thereof are opposite, and when one of the first light-emitting unit group and the second light-emitting unit group is in a positive ON status, the other is in a negative OFF status. When the CCT switching unit is in a first operating mode, the first light-emitting unit group is in the positive ON status, and the CCT switchable illuminating device emits light with a first CCT. When the CCT switching unit is in a second operating mode, the second light-emitting unit group is in electrical conduction, and the CCT switchable illuminating device emits light with a second CCT. Therefore, the problem that the illuminating device in the prior art has a single CCT is solved.

20 Claims, 6 Drawing Sheets

(51) Int. Cl.
*H05B 45/345* (2020.01)
*F21K 9/238* (2016.01)

(a) (b)

CCT SWITCHABLE ILLUMINATING DEVICE

TECHNICAL FIELD

The disclosure relates to the technical field of illumination, and in particular to a switchable Correlated Color Temperature (CCT) illuminating device.

BACKGROUND

A light-emitting diode (LED) illuminating device in the prior art comprises a plurality of LEDs arranged on a circuit board in series or in parallel, and all or part of the LEDs are switched on or switched off simultaneously. Therefore, a Correlated Color Temperature (CCT) of the LED illuminating device after delivery will remain unchanged in an operating status. When a user needs to change the CCT of the illuminating device, a former LED illuminating device has to be replaced, thereby not only bringing certain economic loss, but also degrading convenience during use.

In order to realize a change of the CCT of the illuminating device, at least two filaments need to be taken usually. A plurality of LEDs on each filament emits one type of CCT, and a plurality of LEDs on another filament emits another type of CCT. Both ends of each filament are provided with a lead-out electrode and a support wire respectively. The support wire is welded on a stem, and the plurality of LEDs is electrically connected with a drive power source through a guide wire within the stem. Since directions of current of all filaments are the same, the number of the guide wires is increased to at least three while the CCT is increased. Wherein one of the guide wires is respectively connected with an anode (common anode) of the two filaments and an anode of the drive power source, and another two guide wires are respectively connected with a cathode of the each filament and a cathode of the drive power source. The number of the guide wires is increased, therefore the stem may easily crack, and inert gas for heat dissipation inside a bulb shell of the illuminating device may leak from a crack of the stem. Thus, safety and service life of the illuminating device may be deteriorated.

In addition, as the CCT increases, the number of the lead-out electrodes and the support wires of the filament also increase, so that the number of spot welding is increased, and accordingly labor cost and manufacturing cost are increased because a production process is complicated and assembling difficulty is increased.

SUMMARY

A main objective of the disclosure is to provide a switchable Correlated Color Temperature (CCT) illuminating device, as to solve the problem that safety and service life of a light-emitting diode (LED) illuminating device in the prior art are reduced, the production process is complicated and the assembling difficulty is increased.

In order to achieve the abovementioned objective, according to an aspect of the disclosure, a switchable CCT illuminating device is provided. The illuminating device may include: a CCT switching unit, the CCT switching unit is electrically connected with a drive power; and a bulb shell, at least one filament being arranged within the bulb shell, and the filament including a substrate, and a first light-emitting unit group and a second light-emitting unit group arranged on the substrate and electrically connected with the CCT switching unit. Each of the first light-emitting unit group and the second light-emitting unit group comprises more than one light-emitting unit, and the first light-emitting unit group and the second light-emitting unit group are connected in parallel and conducting directions thereof are opposite. When one of the first light-emitting unit group and the second light-emitting unit group is in a positive ON status, the other is in a negative OFF status, wherein when the CCT switching unit is in a first operating mode, the first light-emitting unit group is in the positive ON status, and the CCT switchable illuminating device emits light with a first CCT, and when the CCT switching unit is in a second operating mode, the second light-emitting unit group is in electrical conduction, and the CCT switchable illuminating device emits light with a second CCT.

In this way, when the CCT switchable illuminating device is illuminating, switching of the CCT may be realized only through the CCT switching unit, so that requirements of a user are satisfied without excessively increasing cost.

Further, according to an embodiment of the disclosure, the CCT switchable illuminating device may further include: a first lead-out electrode, the first light-emitting unit group and the second light-emitting unit group forming the electrical connection with the CCT switching unit through the first lead-out electrode, a first end of the first light-emitting unit group being connected to the first lead-out electrode, and a first end of the second light-emitting unit group being connected to the first lead-out electrode, wherein a polarity of the first end of the first light-emitting unit group is opposite to that of the first end of the second light-emitting unit group, and a second lead-out electrode, the first light-emitting unit group and the second light-emitting unit group forming the electrical connection with the CCT switching unit through the second lead-out electrode, a second end of the first light-emitting unit group being connected to the second lead-out electrode, and a second end of the second light-emitting unit group being connected to the second lead-out electrode, wherein a polarity of the second end of the first light-emitting unit group is opposite to that of the second end of the second light-emitting unit group.

In this way, the electrical connection of the light-emitting unit groups with different CCT may be realized by arranging the two lead-out electrodes, so that production and installation may be facilitated.

Further, according to an embodiment of the disclosure, the CCT switchable illuminating device may further include: a stem, the first lead-out electrode forming electrical connection with the CCT switching unit through a first support wire and a first guide wire of the stem, and the second lead-out electrode forming electrical connection with the CCT switching unit through a second support wire and a second guide wire of the stem.

In this way, the electrical connection of the light-emitting unit groups with the different CCT may be realized by arranging the two support wires, so that production cost may be reduced, and installation may be facilitated.

Further, according to an embodiment of the disclosure, the drive power source is a constant current source. The constant current source converts an alternating current voltage to a direct current voltage having certain ripples, the direct current voltage having the certain ripples is applied to both ends of the filament inside the bulb shell through the CCT switching unit, and the constant current source is output to the first light-emitting unit group and the second light-emitting unit group in a constant-current mode through internal control.

In this way, performance of the CCT switchable illuminating device may be more stable by providing the constant current source.

Further, according to an embodiment of the disclosure, the constant current source supports a dimming mode, and the dimming mode may include a Triac controlled dimming mode, a simulation dimming mode and a digital dimming mode.

In this way, the performance of the CCT switchable illuminating device may be more stable by providing the constant current source compatible with dimming.

Further, according to an embodiment of the disclosure, the CCT switching unit comprises a mechanical switch, and the mechanical switch is a double-pole and double-throw switch. When the double-pole and double-throw switch is thrown toward a first side, the first light-emitting unit group is in the electrical conduction, and the CCT switchable illuminating device emits the light with the first CCT; and when the double-pole and double-throw switch is thrown toward a second side, the second light-emitting unit group is in the electrical conduction, and the CCT switchable illuminating device emits the light with the second CCT.

In this way, switching of the CCT may be facilitated by using the double-pole and double-throw switch as the mechanical switch.

Further, according to an embodiment of the disclosure, the CCT switching unit comprises a control circuit, and the control circuit may include a micro-control unit, a direct-current supply unit and a switch current reversing unit. When the micro-control unit controls the switch current reversing unit to be in a first ON status, the drive power source is supplied to the first light-emitting unit group through the direct-current supply unit and the switch current reversing unit in the first ON status, and the CCT switchable illuminating device emits the light with the first CCT; and when the micro-control unit controls the switch current reversing unit to be in a second ON status, the drive power source is supplied to the second light-emitting unit group through the direct-current supply unit and the switch current reversing unit in the second ON status, and the CCT switchable illuminating device emits the light with the second CCT.

In this way, the switching of the CCT may be facilitated by using the control circuit as the CCT switching unit.

Further, according to an embodiment of the disclosure, the control circuit may include: a Bluetooth control unit, a Wireless Fidelity (WIFI) control unit or an infrared control unit. The control circuit may further include a direct-current supply unit and a switch current reversing unit. Wherein when the Bluetooth control unit, the WIFI control unit or the infrared control unit controls the switch current reversing unit to be in a first ON status, the drive power source is supplied to the first light-emitting unit group through the direct-current supply unit and the switch current reversing unit in the first ON status, and the CCT switchable illuminating device emits the light with the first CCT; and when the Bluetooth control unit, the WIFI control unit or the infrared control unit controls the switch current reversing unit to be in a second ON status, the drive power source is supplied to the second light-emitting unit group through the direct-current supply unit and the switch current reversing unit in the second ON status, and the CCT switchable illuminating device emits the light with the second CCT.

In this way, the switching of the CCT may be facilitated by using the control circuit as the CCT switching unit.

Further, according to an embodiment of the disclosure, the control circuit realizes selective electrical conduction of the first light-emitting unit group and the second light-emitting unit group according to an instruction from a remote controller and/or an application program running on a smart device.

In this way, the switching of the CCT may be facilitated through operating according to the instruction from the remote controller and/or the application program running on the smart device.

Further, according to an embodiment of the disclosure, the control circuit detects a connection or disconnection status of a wall switch forming electrical connection with the CCT switchable illuminating device, and the control circuit realizes the selective electrical conduction of the first light-emitting unit group and the second light-emitting unit group by making use of the wall switch when detecting that the wall switch is subjected to one or more on/off operations.

In this way, the switching of the CCT may be facilitated by operations through the wall switch.

Further, according to an embodiment of the disclosure, the control circuit implements the selective electrical conduction of the first light-emitting unit group and the second light-emitting unit group according to a signal sent by a Triac dimming driver forming electrical connection with the CCT switchable illuminating device.

Further, according to an embodiment of the disclosure, the first light-emitting unit group may include at least two first light-emitting units that are connected in series, and the second light-emitting unit group may include at least two second light-emitting units that are connected in series. The first light-emitting unit is a first CCT LED, the second light-emitting unit is a second CCT LED. The CCT of the first CCT LED is 2700K, and the CCT of the second CCT LED is 5000K.

In this way, the switching of the CCT may be facilitated by selecting the LEDs with the different CCT according to requirements of an application field.

Further, according to an embodiment of the disclosure, the first light-emitting unit group may include at least two first light-emitting units and at least one common unit that are connected in series, and the second light-emitting unit group may include at least two second light-emitting units and the at least one common unit that are connected in series. The common unit is arranged to be in a positive ON status when any of the first light-emitting unit group and the second light-emitting unit group is in the positive ON status. The first light-emitting unit is a third CCT LED, the second light-emitting unit is a fourth CCT LED, and the common unit is a fifth CCT LED. Wherein a fifth CCT is greater than a third CCT and less than a fourth CCT, the third CCT is 2000K, the fourth CCT is 6500K, and the fifth CCT is 4000K. The CCT of the third CCT LED and the CCT of the fifth CCT LED are mixed to present the first CCT, and the CCT of the fourth CCT LED and the CCT of the fifth CCT LED are mixed to present the second CCT.

In this way, the first light-emitting unit group and the second light-emitting unit group share one or more light-emitting units, so that the switching of the CCT may be realized and the number of the LEDs may be reduced.

Further, according to an embodiment of the disclosure, the first light-emitting unit group and the second light-emitting unit group are arranged on the same substrate, or the first light-emitting unit group and the second light-emitting unit group are arranged on different substrates respectively.

In this way, specific configuration of the CCT switchable illuminating device may be flexibly selected according to a scenario and design requirements.

Further, according to an embodiment of the disclosure, the number of the filaments is two, four or six, the first light-emitting unit groups of the two, four or six filaments are connected in series, and the second light-emitting unit groups of the two, four or six filaments are connected in series.

In this way, appearance of the CCT switchable illuminating device may be more beautiful.

The technical solution of the disclosure provides a CCT switchable illuminating device, and the number of the guide wires inside the stem of the CCT switchable illuminating device is reduced to two from three by arranging LED groups with different CCT to be in reverse parallel connection, so that the safety and the service life are improved. In addition, each end of the each filament is provided with one lead-out electrode and one support wire only, so that the number of spot welding of the filament is reduced, and accordingly the cost is low and assembling is convenient. In addition, the switching of the CCT of the CCT switchable illuminating device is conveniently realized by cooperating with the corresponding mechanical switch and/or the control circuit.

BRIEF DESCRIPTION OF THE DRAWINGS

The accompanying drawings described herein are used to provide a further understanding of the disclosure, and constitute a part of the application, and the exemplary embodiments of the disclosure and the description thereof are used to explain the disclosure, but do not constitute improper limitations to the disclosure. In the drawings.

Figure 1:
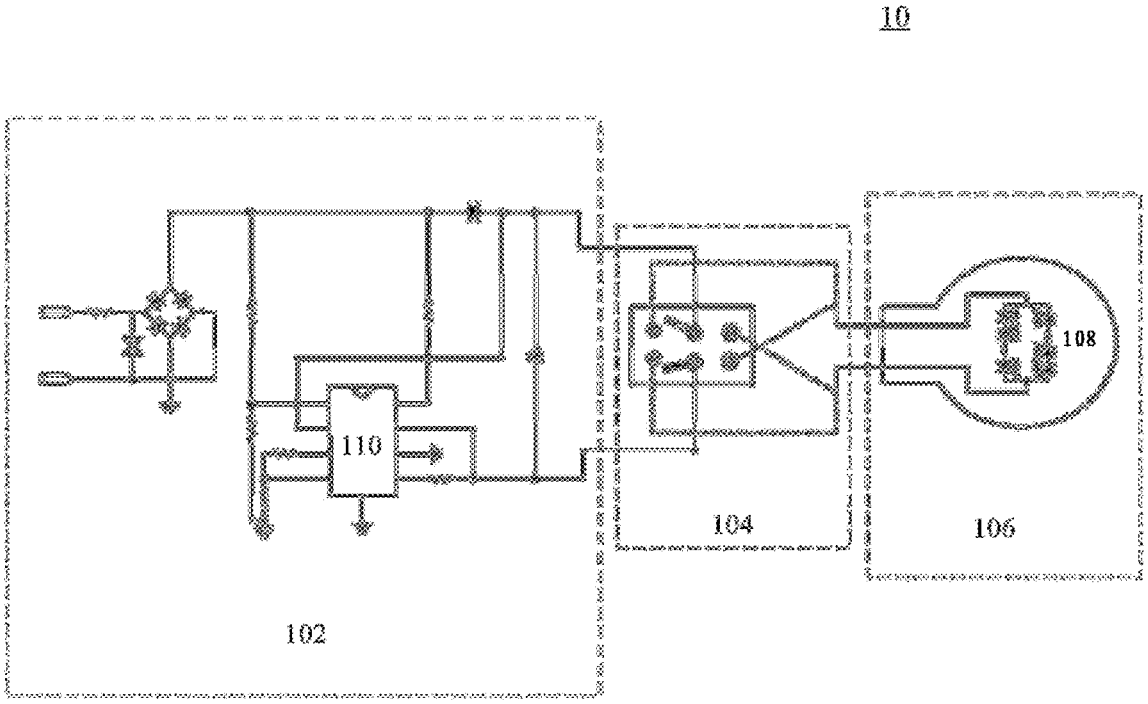
FIG. 1 shows a schematic diagram of an embodiment of a CCT switchable illuminating device according to an embodiment of the disclosure.

wherein the abovementioned drawings may include the following reference numbers:

10: CCT switchable illuminating device;
102: drive power source;
104: CCT switching unit;
106: bulb shell;
108: filament;
110: Triac dimming driver;
202: first light-emitting unit group;
204: second light-emitting unit group;
206, 306: first lead-out electrode;
208, 308: second lead-out electrode;
210, 310: stem;
212, 312: first support wire;
214, 314: second support wire;
216, 316: first guide wire;
218, 318: second guide wire;
50: CCT switchable illuminating device;
502: drive power source;
504: CCT switching unit;
504-2: direct-current supply unit;
504-4: switch current reversing unit
504-6: micro-control unit;
506: bulb shell;
508: filament;
510: first light-emitting unit group;
512: second light-emitting unit group;
602: filament;
604: support wire;
606: guide wire;
608: stem.

DETAILED DESCRIPTION OF THE EMBODIMENTS

It is to be noted that embodiments in the application and features in the embodiments may be combined with each other without conflict. The disclosure will be described below in detail with reference to drawings and in combination with the embodiments.

It should be pointed out that, unless otherwise indicated, all technical and scientific terms used in the application have meanings identical with those generally understood by those of ordinary skill in the art of the application.

In the disclosure, when there is no contrary description available, terms used wherein such as "upper", "lower", "top" and "bottom" are for directions shown in the drawings, or for the parts in vertical, perpendicular or gravitational directions. Likewise, in order to facilitate understanding and description, terms "inner" and "outer" are the inside and the outside relative to an outline of each part, but the abovementioned terms are not intended to limit the disclosure.

In order to solve the problem that an illuminating device in the prior art has a single Correlated Color Temperature (CCT), a CCT switchable illuminating device is provided.

FIG. 1 shows a schematic diagram of an embodiment of a switchable Correlated Color Temperature (CCT) illuminating device according to an embodiment of the disclosure. As shown in FIG. 1, the CCT switchable illuminating device 10 may include: a drive power source 102, a CCT switching unit 104 and a bulb shell 106.

Figure 2:
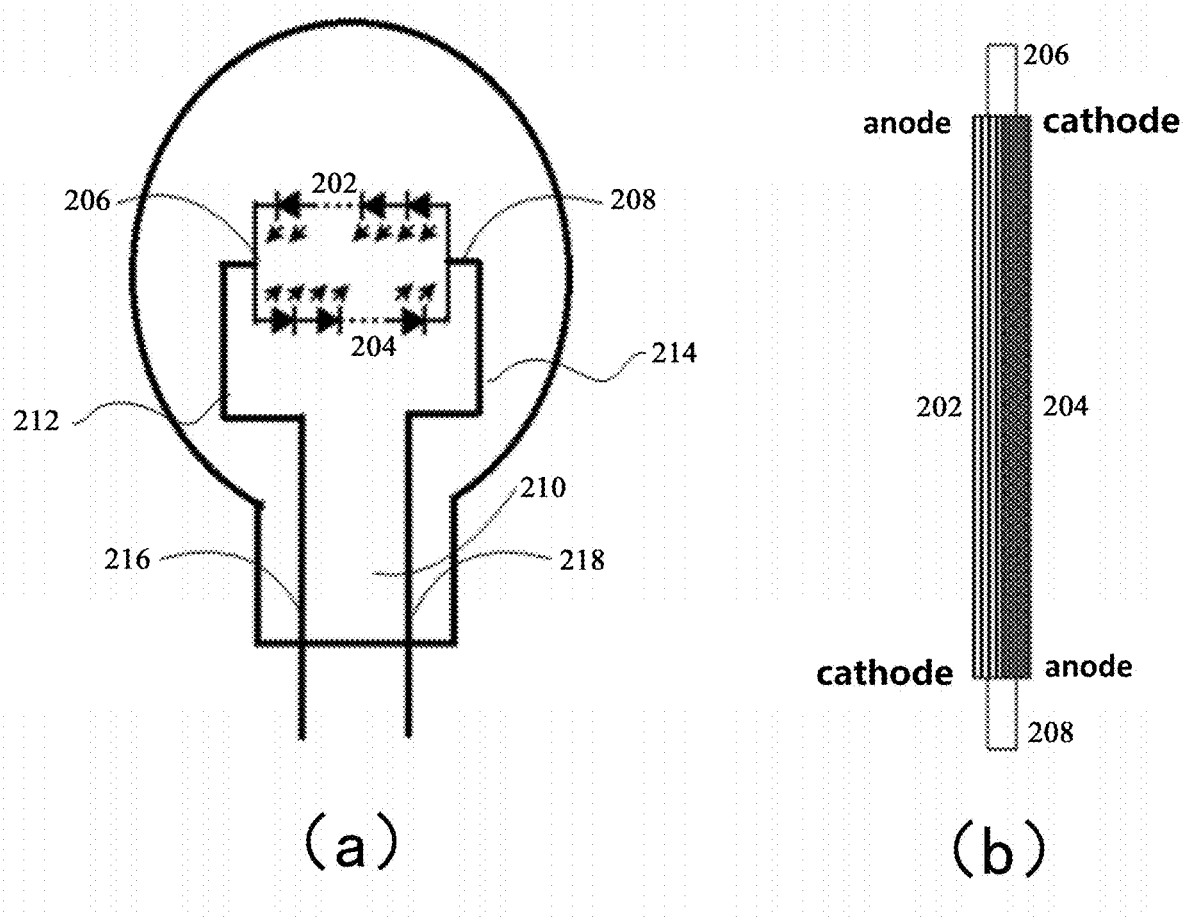
FIG. 2 shows a schematic diagram of a specific structure of a filament of a CCT switchable illuminating device according to an embodiment of the disclosure.
Figure 4:
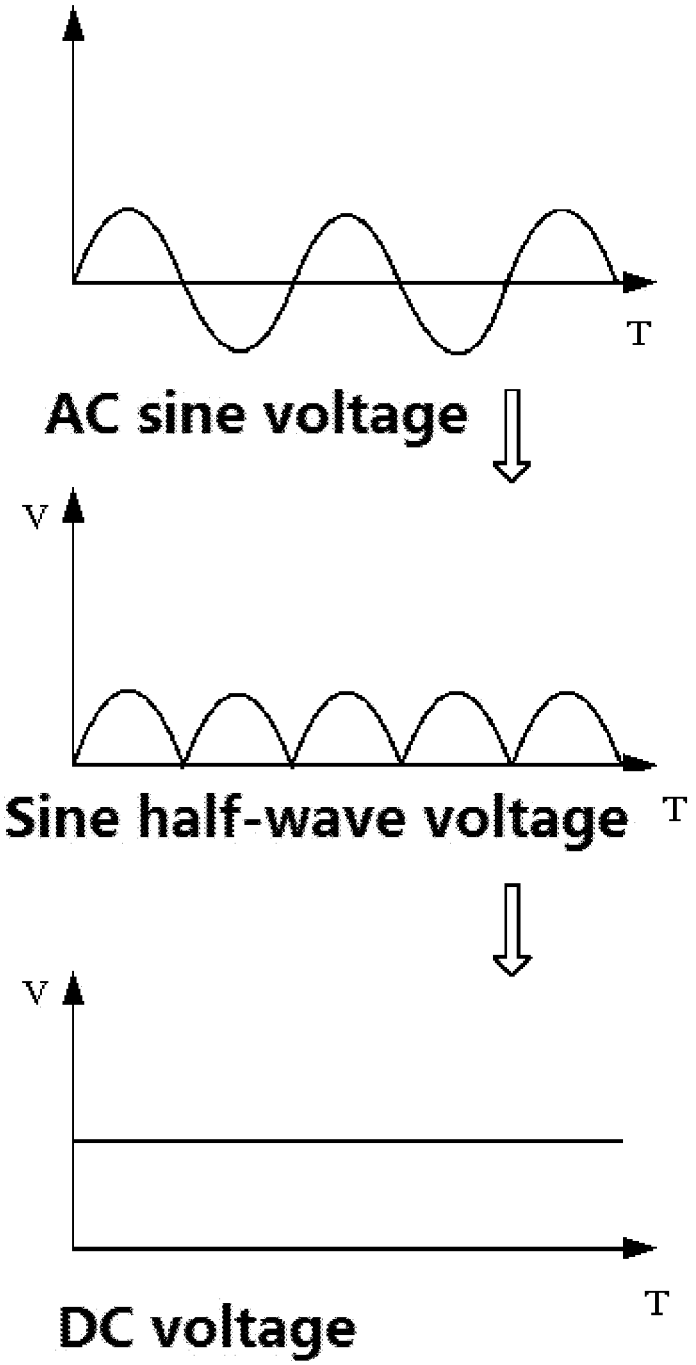
FIG. 4 shows a voltage waveform diagram of a drive power source of a CCT switchable illuminating device according to the disclosure.

The drive power source 102 is a constant current source. The constant current source converts an alternating current voltage to a direct current voltage having certain ripples, and the direct current voltage is applied to both ends of a first support wire 212 and a second support wire 214 (as shown in FIG. 2) close to a filament 108 after passing the CCT switching unit 104. The constant current source is finally supplied to a filament 108 in a constant-current output mode under internal control. The drive power source 102 may include a Triac dimming driver 110, as to realize adjustment of brightness. FIG. 4 shows a voltage waveform diagram of the drive power source. Besides a Triac dimming driver, the disclosure may further adopt other dimming modes, such as (but not limited to): a simulation dimming mode and a digital dimming mode.

The CCT switching unit 104 forms electrical connection with the drive power source 102 through wires. In FIG. 1, the CCT switching unit 104 comprises a mechanical switch, and a double-pole and double-throw switch may be used as the mechanical switch. However, besides the double-pole and double-throw switch, the disclosure may further adopt other switching modes, such as (but not limited to) a control circuit that will be described below in detail with reference to FIG. 5.

At least one filament 108 is arranged inside the bulb shell 106, and each filament 108 may respectively include a substrate, and a first light-emitting unit group and a second light-emitting unit group that are arranged on the substrate. In order to facilitate assembling and achieve beautiful appearance, the first light-emitting unit group and the second light-emitting unit group may be positioned in a package module on the same substrate. Alternatively, the first light-emitting unit group and the second light-emitting unit group may be positioned on different substrates. Under a situation that the light-emitting unit groups are arranged on the different substrates, a standard filament may be taken to manufacture the CCT switchable illuminating device, so that reduction of cost is achieved. Under a situation that the light-emitting unit groups are arranged on the same substrate, a production process may be simplified. Further, a light-emitting diode (LED) may be taken as a light-emitting unit, so that advantages including energy saving and environmental protection of the LED may be utilized. Meanwhile, a filament including the LED is arranged inside the CCT switchable illuminating device, so that 360-degree all-round light-emitting may be achieved, and advantages of a former filament lamp may be retained. In order to achieve different CCT, a first light-emitting unit and a second light-emitting unit may emit light with a first CCT and light with a second CCT, respectively. For example, the CCT of the first light-emitting unit may be 2700K, and the CCT of the second light-emitting unit may be 5000K.

As shown in FIG. 2(*a*) and FIG. 2(*b*), the first light-emitting unit group 202 and the second light-emitting unit group 204 are positioned on the same substrate, one end of the substrate is provided with a first lead-out electrode 206, the first lead-out electrode 206 forms electrical connection with the CCT switching unit 104 through the first support wire 212 and a first guide wire 216 inside a stem 210, a first end of the first light-emitting unit group 202 is connected to the first lead-out electrode 206, a first end of the second light-emitting unit group 204 is connected to the first lead-out electrode 206, wherein a polarity of the first end of the first light-emitting unit group 202 is opposite to that of the first end of the second light-emitting unit group 204;

the other end of the substrate is provided with a second lead-out electrode 208, the second lead-out electrode 208 forms electrical connection with the CCT switching unit 104 through the second support wire 214 and a second guide wire 218 inside the stem 210, a second end of the first light-emitting unit group 202 is connected to the second lead-out electrode 208, a second end of the second light-emitting unit group 204 is connected to the second lead-out electrode 208, wherein a polarity of the second end of the first light-emitting unit group 202 is opposite to that of the second end of the second light-emitting unit group 204. For example, as shown in a partial enlarged drawing of FIG. 2(*b*), an anode of the first light-emitting unit group 202 and a cathode of the second light-emitting unit group 204 are connected to the same lead-out electrode 206, and a cathode of the first light-emitting unit group 202 and an anode of the second light-emitting unit group 204 are connected to the same lead-out electrode 208. Therefore, a conducting direction of the first light-emitting unit group 202 is opposite to that of the second light-emitting unit group 204, namely, the first light-emitting unit group and the second light-emitting unit group are connected to the same lead-out electrode with opposite polarities.

The stem 210 as shown in FIG. 2 is characterized in that the first lead-out electrode 206 is connected with one end of the first support wire 212, and the other end of the first support wire 212 is connected with one end of the first guide wire 216 inside the stem 210, the other end of the first guide wire 216 forms electrical connection with the CCT switching unit 104, the second lead-out electrode 208 is connected with one end of the second support wire 214, the other end of the second support wire 214 is connected with one end of the second guide wire 218 inside the stem 210, and the other end of the second guide wire 218 forms electrical connection with the CCT switching unit 104. In a structure of the CCT switchable illuminating device shown in FIG. 1 and FIG. 2, switching of more than two CCT may be achieved by using one substrate, two lead-out electrodes (namely, the first lead-out electrode 206 and the second lead-out electrode 208), two support wires (namely, the first support wires 212 and the second support wire 214) and two guide wires (namely, the first guide wire 216 and the second guide wire 218) for the one filament 108 only. Compared with the adjustment of the CCT in the prior art, the number of the lead-out electrodes, the number of the support wires and the number of the guide wires are reduced, and accordingly the number of spot welding may be reduced. In this way, parts for the CCT switchable illuminating device are simpler in assembling and convenient in production, and reduction of labor cost and manufacturing cost may be achieved. Meanwhile, since the guide wire is positioned inside the stem, the smaller the number of the guide wires is, the less likely the stem cracks, and the less likely inert gas for heat dissipation inside the bulb shell leaks from a crack of the stem. In this way, safety and service life of the CCT switchable illuminating device are improved.

Alternatively, more than two LEDs that are connected in series to form the first light-emitting unit group 202 and more than two LEDs that are connected in series to form the second light-emitting unit group 204 may be arranged on the different substrates, so that the standard filament may be taken for production, and accordingly customization cost may be reduced. That is to say, since conducting directions of current in the two groups of light-emitting units are opposite, two substrates, four lead-out electrodes and four support wires are used for the two filaments 108, but two guide wires (namely, the first guide wire 216 and the second guide wire 218) are required only, and accordingly the switching of two or more CCT may be achieved. Compared with the prior art of adjusting the CCT, the number of the guide wires is still reduced, so that the parts for the CCT switchable illuminating device are simpler in assembling and convenient in production, and reduction of labor cost and manufacturing cost is achieved. The smaller the number of the guide wires is, the less likely the stem cracks, and the less likely the inert gas for heat dissipation inside the bulb shell leaks from the crack of the stem. In this way, the safety and the service life of the CCT switchable illuminating device are improved. Compared with an embodiment in the disclosure that the light-emitting units are arranged on the same substrate, the standard filament (namely, a universal component) may be taken for production in allusion to the light-emitting units arranged on the different substrates, in this way the customization cost is reduced.

In addition, compared with a double-CCT illuminating device having four or more lead-out electrodes and support wires in the prior art, the CCT switchable illuminating device of the disclosure is more concise and beautiful.

Using structures shown in FIG. 1 and FIG. 2, the switching of the CCT of the illuminating device may be achieved by using the CCT switching unit only. For example, a double-pole double-throw switch is used as the CCT switching unit 104, when the double-pole double-throw switch is thrown to a left side, the first light-emitting unit group 202 is in electrical conduction and emits the light with the first CCT, and when the double-pole double-throw switch is thrown to a right side, the second light-emitting unit group 204 is in electrical conduction and emits the light with the second CCT. A block 104 shown in FIG. 1 is characterized in that a short dotted line herein indicates that the first light-emitting unit group is in an ON status when the double-pole double-throw switch is thrown to the left side, and a long dotted line herein indicates that the second light-emitting unit group is in an ON status when the double-pole double-throw switch is thrown to the right side.

Figure 3:
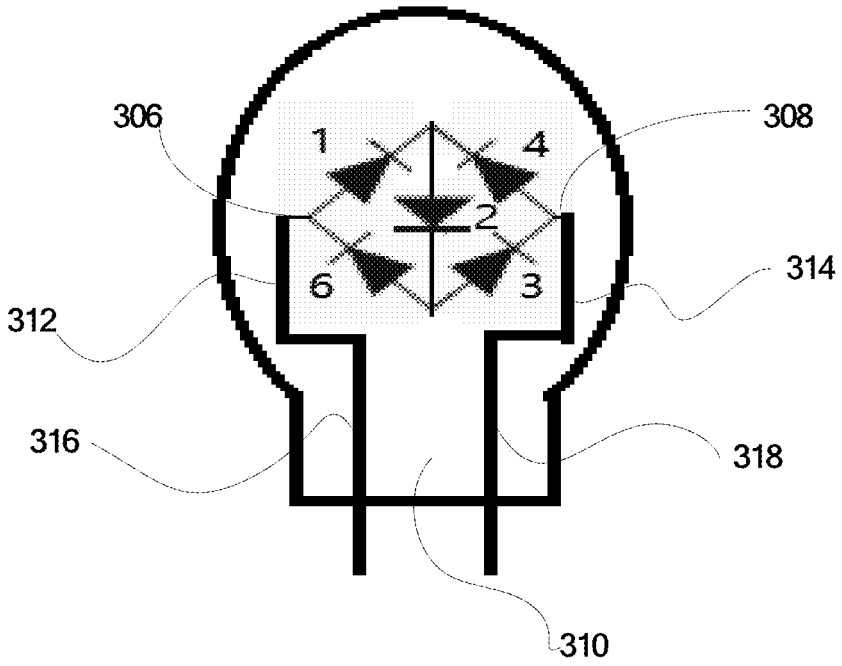
FIG. 3 shows a schematic diagram of a specific structure of a filament of a CCT switchable illuminating device according to another embodiment of the disclosure.

FIG. 3 shows a schematic diagram of a specific structure of a filament of a CCT illuminating device according to another embodiment of the disclosure, and the filament herein may be used for replacing the filament inside the bulb shell 106 in FIG. 1. Main differences of filament structures shown in FIG. 3 and FIG. 2 are: in FIG. 3, a first light-emitting unit group may include at least three first light-emitting units connected in series, namely an LED 1, an LED 2 and an LED 3, a second light-emitting unit group may include at least three second light-emitting units connected in series, namely an LED 4, an LED 2 and an LED 6. The LED 2 is used as a common unit and shared by the first light-emitting unit group and the second light-emitting unit group. The LED 2 is configured to be in a positive ON status when any of the first light-emitting unit group and the second light-emitting unit group is in a positive ON status. The LED 1 and the LED 3 are low-CCT LEDs, the LED 4 and the LED 6 are high-CCT LEDs, and the LED 2 is a medium-CCT LED, wherein the CCT of the low-CCT LED is 2000K, the CCT of the high-CCT LED is 6500K, and the CCT of the medium-CCT LED is 4000K. The CCT of the low-CCT LED and the CCT of the medium-CCT LED are mixed to present the first CCT 2700K, and the CCT of the high-CCT LED and the CCT of the medium-CCT LED are mixed to present the second CCT 5000K. The LED 2 is used as the common unit and shared by the first light-emitting unit group and the second light-emitting unit group, so that effective utilization of the LED may be achieved. In this way, an expected function of switching the CCT is ensured to be achieved, the number of the LEDs is minimized, and production cost is reduced. The first light-emitting unit group and the second light-emitting unit group may be positioned on the same substrate, one end of the substrate is provided with a first lead-out electrode 306. The first lead-out electrode 306 forms an electrical connection with a CCT switching unit 104 through a first support wire 312 and a first guide wire 316 inside a stem 310. A first end of the first light-emitting unit group is connected to the first lead-out electrode 306, and a first end of the second light-emitting unit group is connected to the first lead-out electrode 306, wherein a polarity of the first end of the first light-emitting unit group is opposite to that of the first end of the second light-emitting unit group. The other end of the substrate is provided with a second lead-out electrode 308, and the second lead-out electrode 308 forms an electrical connection with the CCT switching unit 104 through a second support wire 314 and a second guide wire 318 inside the stem 310. A second end of the first light-emitting unit group is connected to the second lead-out electrode 308, and a second end of the second light-emitting unit group is connected to the second lead-out electrode 308, wherein a polarity of the second end of the first light-emitting unit group is opposite to that of the second end of the second light-emitting unit group.

Alternatively, similar to the specific structure of the filament depicted in FIG. 2, in the specific structure of the filament of the CCT switchable illuminating device shown in FIG. 3, the LED 1, LED 2, LED 3, LED 4 and LED 6 may be arranged on the same substrate. Since conducting directions of current in the two groups of light-emitting units are opposite, one substrate, two lead-out electrodes (namely, the first lead-out electrode 306 and the second lead-out electrode 308), two support wires (namely, the first support wire 312 and the second support wire 314) and two guide wires (namely, the first guide wire 316 and the second guide wire 318) are taken only for the one filament, so that switching of two or more CCT may be achieved. Compared with the adjustment of the CCT in the prior art, the number of the lead-out electrodes, the number of the support wires and the number of the guide wires are reduced, and accordingly the number of spot welding is reduced, so that parts for the CCT switchable illuminating device are simpler in assembling and convenient in production, and reduction of labor cost and manufacturing cost is achieved. Meanwhile, since the guide wire is positioned inside the stem, the smaller the number of the guide wires is, the less likely the stem cracks, and the less likely inert gas for heat dissipation inside the bulb shell leaks from a crack of the stem. In this way, safety and service life of the CCT switchable illuminating device are improved.

In the specific structure of the filament of the CCT switchable illuminating device shown in FIG. 3, three paths, including the path of the LED1 and LED3, the path of the LED2, and the path of the LED4 and LED6 may be arranged on the different substrates respectively, so that a standard filament may be applied to production. Therefore, customization cost may be reduced.

Figure 5:
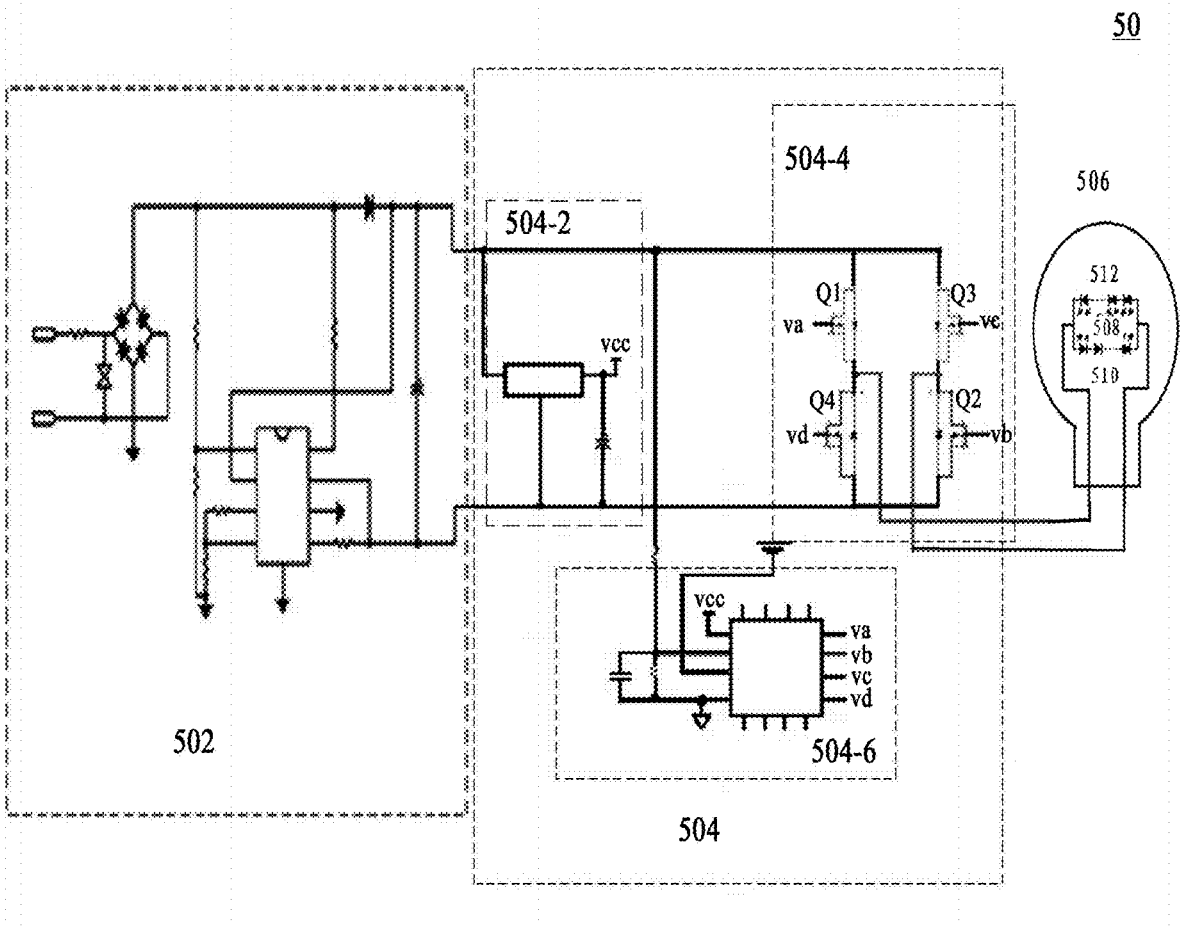
FIG. 5 shows a schematic diagram of an embodiment of a CCT switchable illuminating device according to an embodiment of the disclosure.

FIG. 5 shows a schematic diagram of an embodiment of a CCT switchable illuminating device according to an embodiment of the disclosure.

As shown in FIG. 5, a CCT switchable illuminating device 50 may include: a drive power source 502, a CCT switching unit 504 and a bulb shell 506.

The drive power source 502, which implements functions similar to the drive power source 102 depicted with reference to FIG. 1, will not be repeated.

The CCT switching unit 504 forms electrical connection with the drive power source 502 through wires. In FIG. 5, the CCT switching unit 504 comprises a control circuit. The control circuit may include a micro-control unit 504-6, a direct-current supply unit 504-2 and a switch current reversing unit 504-4. When the micro-control unit 504-6 controls the switch current reversing unit 504-4 to be in a first ON status, the drive power source 502 is supplied to a first light-emitting unit group 510 through the direct-current supply unit 504-2 and the switch current reversing unit 504-4 in the first ON status, and the CCT switchable illuminating device 50 emits light with a first CCT. When the micro-control unit 504-6 controls the switch current reversing unit 504-4 to be in a second ON status, the drive power source 502 is supplied to a second light-emitting unit group 512 through the direct-current supply unit 504-2 and the switch current reversing unit 504-4 in the second ON status, and the CCT switchable illuminating device 50 emits light with a second CCT. Specifically, when the micro-control unit 504-6 controls switches Q3 and Q4 in the switch current reversing unit 504-4 to be switched off and switches Q1 and Q2 in the switch current reversing unit 504-4 to be switched on, the drive power source 502 is supplied to the first light-emitting unit group 510 through the direct-current supply unit 504-2 and the switch current reversing unit 504-4, so that the first light-emitting unit group 510 is in electrical conduction. When the micro-control unit 504-6 controls the switches Q1 and Q2 in the switch current reversing unit 504-4 to be switched off and the switches Q3 and Q4 in the switch current reversing unit 504-4 to be switched on, the drive power source 502 is supplied to the second light-emitting unit group 512 through the direct-current supply unit 504-2 and the switch current reversing unit 504-4, so that the second light-emitting unit group 512 is in electrical conduction. The switches Q1 and Q3 may be PMOS or PNP-BJT, and the switches Q2 and Q4 may be NMOS or NPN-BJT. A relationship between voltages of the switches Q1, Q2, Q3 and Q4 and the electrical conduction of the first light-emitting unit group and the second light-emitting unit group is shown in Table 1 below:

TABLE 1

| Electrical conduction mode | Va | Vb | Vc | Vd |
|---|---|---|---|---|
| First light-emitting unit group 510 | 0 | 1 | 1 | 0 |
| Second light-emitting unit group 512 | 1 | 0 | 0 | 1 |

In addition, the micro-control unit 504-6 may be replaced by a Bluetooth control unit, a Wireless Fidelity (WIFI) control unit or an infrared control unit. Through taking the Bluetooth control unit, the WIFI control unit or the infrared control unit as a part forming the CCT switching unit, selective electrical conduction of the first light-emitting unit group and the second light-emitting unit group may be implemented according to an instruction from a remote controller and/or an application program running on a smart device.

In addition, resistors R1 and R2 and a capacitor C1 in the micro-control unit 504-6 are configured to detect a disconnection or connection status of a wall switch (not shown) forming electrical connection with the CCT switchable illuminating device 50, and the CCT switching unit 504 implements the selective electrical conduction of the first light-emitting unit group and the second light-emitting unit group by making use of the wall switch when detecting that the wall switch is subjected to one or more on/off operations.

The bulb shell 506 implements functions like those of the bulb shell 106 described in FIG. 1. Besides a structure of two paths of LEDs in FIG. 2, a specific structure of a filament arranged inside the bulb shell 506 may use a structure of three paths of LEDs in FIG. 3 as well. Please see Table 1 for a specific drive mode of the three paths of LEDs, and the specific drive mode will not be repeated.

Figure 6:
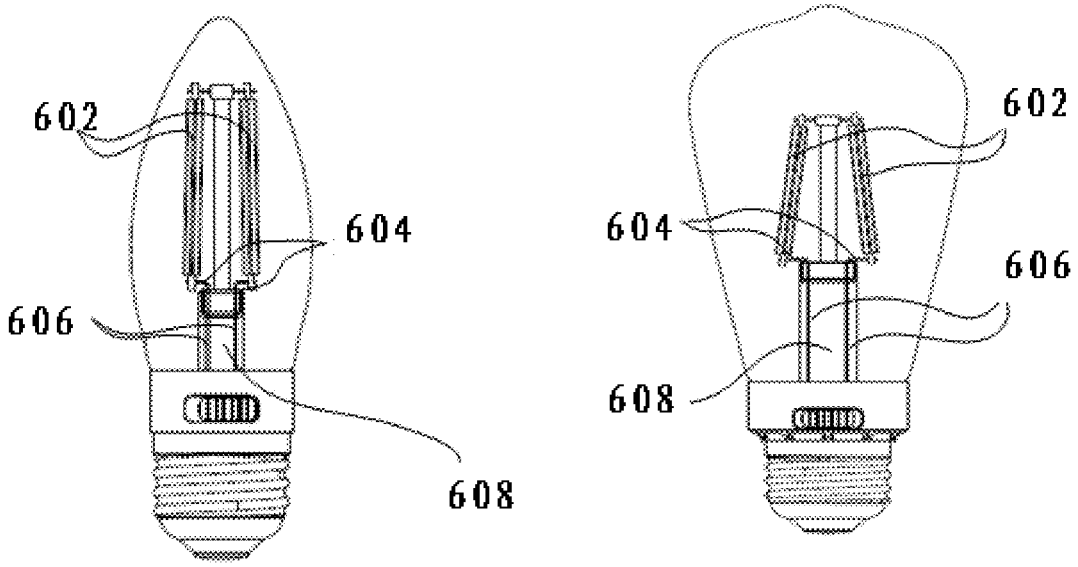
FIG. 6 shows a schematic diagram of appearance of a CCT switchable illuminating device according to an embodiment of the disclosure.

FIG. 6 shows a schematic diagram of appearance of a CCT switchable illuminating device according to an embodiment of the disclosure. FIG. 6 (*a*) and FIG. 6 (*b*) show the CCT switchable illuminating devices with different appearances according to the disclosure. In FIG. 6, 602 represents a filament, 604 represents a support wire, 606 represents a guide wire, and 608 represents a stem. In order to meet the requirements for beautiful appearance and practical illumination application environment and design, two filaments that are connected in series are usually arranged inside a bulb shell. First light-emitting unit groups of the two filaments are connected in series, and second light-emitting unit groups of the two filaments are connected in series. The first light-emitting unit group and the second light-emitting unit group of each filament are in reverse parallel connection, in this way when a CCT switching unit selects a first CCT, the first light-emitting unit groups of the two filaments are switched on and emit light with the first CCT, and when the CCT switching unit selects a second CCT, the second light-emitting unit groups of the two filaments are switched on and emit light with the second CCT.

In addition, as an alternative, the number of the filaments may be four or six, and the like, and lead-out electrodes and the support wires with number consistent with that of the filaments are arranged inside the bulb shell. Therefore, the filaments form electrical connection with the guide wires in the stem through the lead-out electrodes, the support wires. In the prior art, three or more guide wires are usually arranged inside the stem, so that electrical connection of the filaments and the drive power source is implemented. However, with increasing the number of the guide wires inside the stem, probability that a crack occurs on the stem may be increased during production and using. Therefore, inert gas for heat dissipation inside the bulb shell may leak from the crack of the stem, and occurrence of this situation may cause the deterioration of safety and service life of the illuminating device. In the disclosure, as shown in FIG. 6, in order to meet design requirements, more than two filaments are arranged, and accordingly the electrical connection of the filaments and the drive power source may be implemented only through the two guide wires. Therefore, complexity of a production process may be reduced, and the probability that the crack occurs on the stem may be greatly reduced and the inert gas for heat dissipation inside the bulb shell may not easily leak from the crack of the stem because the number of the guide wires is reduced, so that the safety and the service life of the CCT switchable illuminating device may be improved.

Here, the disclosure is implemented with an optimal mode, so that the problem that the illuminating device in the prior art has the single CCT is solved.

From the abovementioned description, the embodiments of the disclosure realize the following technical effects.

1. The illuminating device is compact in structure and convenient in assembling.

2. The structure is simple, and the cost is reduced.

3. The illuminating device is easy to operate, and user experience is improved.

It is apparent that the described embodiments are not all embodiments but part of embodiments of the disclosure. All other embodiments obtained by those of ordinary skill in the art on the basis of the embodiments in the disclosure without creative work shall fall within the scope of protection of the disclosure.

It is to be noted that terms used herein are merely intended to describe specific embodiments rather than limit exemplary embodiments according to the application. Unless otherwise pointed out explicitly, a singular form used herein is also intended to include a plural form. In addition, it should also be understood that the term "include" and/or "comprise" used in the description indicates that there are features, steps, operations, devices, assemblies and/or combinations thereof.

It is to be noted that expression "first", "second" and the like in the description, claims and the abovementioned drawings of the application are used for distinguishing similar objects rather than describing a specific sequence or a precedence order. It should be understood that the data used in such a way may be exchanged where appropriate, in order that the embodiments of the application described here may be implemented in a sequence other than sequences graphically shown or described here.

The above are only preferred embodiments of the disclosure and are not intended to limit the disclosure. Those skilled in the art may make various modifications and variations. Any modifications, equivalent replacements, improvements and the like made within the spirit and principle of the disclosure shall fall within the scope of protection of the disclosure.

What is claimed is:

1. A switchable Correlated Color Temperature (CCT) illuminating device, comprising:

a CCT switching unit, the CCT switching unit is electrically connected with a drive power source; and a bulb shell, at least one filament being arranged inside the bulb shell, the filament comprising a substrate, and a first light-emitting unit group and a second light-emitting unit group arranged on the substrate and electrically connected with the CCT switching unit, wherein each of the first light-emitting unit group and the second light-emitting unit group comprises one or more light-emitting unit, the first light-emitting unit group and the second light-emitting unit group are connected in parallel and conducting directions thereof are opposite, and when one of the first light-emitting unit group and the second light-emitting unit group is in a positive ON status, the other is in a negative OFF status;

wherein when the CCT switching unit is in a first operating mode, the first light-emitting unit group is in the positive ON status, and the CCT switchable illuminating device emits light with a first CCT; and when the CCT switching unit is in a second operating mode, the second light-emitting unit group is in electrical conduction, and the CCT switchable illuminating device emits light with a second CCT.

2. The CCT switchable illuminating device according to claim 1, wherein the CCT switchable illuminating device further comprises:

a first lead-out electrode, the first light-emitting unit group and the second light-emitting unit group forming electrical connection with the CCT switching unit through the first lead-out electrode, a first end of the first light-emitting unit group being connected to the first lead-out electrode, a first end of the second light-emitting unit group being connected to the first lead-out electrode, wherein a polarity of the first end of the first light-emitting unit group is opposite to that of the first end of the second light-emitting unit group; and a second lead-out electrode, the first light-emitting unit group and the second light-emitting unit group forming electrical connection with the CCT switching unit through the second lead-out electrode, a second end of the first light-emitting unit group being connected to the second lead-out electrode, a second end of the second light-emitting unit group being connected to the second lead-out electrode, wherein a polarity of the second end of the first light-emitting unit group is opposite to that of the second end of the second light-emitting unit group.

3. The CCT switchable illuminating device according to claim 2, wherein the CCT switchable illuminating device further comprises:

a stem, the first lead-out electrode forming electrical connection with the CCT switching unit through a first support wire and a first guide wire of the stem, and the second lead-out electrode forming electrical connection with the CCT switching unit through a second support wire and a second guide wire of the stem.

4. The CCT switchable illuminating device according to claim 1, wherein the drive power source is a constant current source; the constant current source converts an alternating current voltage to a direct current voltage having certain ripples; the direct current voltage having the certain ripples is applied to both ends of the filament inside the bulb shell via the CCT switching unit; and the constant current source is output to the first light-emitting unit group and the second light-emitting unit group in a constant-current mode through internal control.

5. The CCT switchable illuminating device according to claim 4, wherein the constant current source supports a dimming mode.

6. The CCT switchable illuminating device according to claim 5, wherein the dimming mode comprises a Triac dimming mode, a simulation dimming mode and a digital dimming mode.

7. The CCT switchable illuminating device according to claim 1, wherein the CCT switching unit comprises a mechanical switch.

8. The CCT switchable illuminating device according to claim 7, wherein the mechanical switch is a double-pole and double-throw switch, wherein when the double-pole and double-throw switch is thrown toward a first side, the first light-emitting unit group is in the electrical conduction, and the CCT switchable illuminating device emits the light with the first CCT; and when the double-pole and double-throw switch is thrown toward a second side, the second light-emitting unit group is in the electrical conduction, and the CCT switchable illuminating device emits the light with the second CCT.

9. The CCT switchable illuminating device according to claim 1, wherein the CCT switching unit comprises a control circuit.

10. The CCT switchable illuminating device according to claim 9, wherein the control circuit comprises a micro-control unit, a direct-current supply unit and a switch current reversing unit, wherein when the micro-control unit controls the switch current reversing unit to be in a first ON status, the drive power source is supplied to the first light-emitting unit group through the direct-current supply unit and the switch current reversing unit in the first ON status, and the CCT switchable illuminating device emits the light with the first CCT; and when the micro-control unit controls the switch current reversing unit to be in a second ON status, the drive power source is supplied to the second light-emitting unit group through the direct-current supply unit and the switch current reversing unit in the second ON status, and the CCT switchable illuminating device emits the light with the second CCT.

11. The CCT switchable illuminating device according to claim 9, wherein the control circuit comprises: a Bluetooth control unit, a Wireless Fidelity (WIFI) control unit or an infrared control unit; the control circuit further comprises a direct-current supply unit and a switch current reversing unit, wherein when the Bluetooth control unit, the WIFI control unit or the infrared control unit controls the switch current reversing unit to be in a first ON status, the drive power source is supplied to the first light-emitting unit group through the direct-current supply unit and the switch current reversing unit in the first ON status, and the CCT switchable illuminating device emits the light with the first CCT; and when the Bluetooth control unit, the WIFI control unit or the infrared control unit controls the switch current reversing unit to be in a second ON status, the drive power source is supplied to the second light-emitting unit group through the direct-current supply unit and the switch current reversing unit in the second ON status, and the CCT switchable illuminating device emits the light with the second CCT.

12. The CCT switchable illuminating device according to claim 11, wherein the control circuit implements selective electrical conduction of the first light-emitting unit group and the second light-emitting unit group according to an instruction from a remote controller and/or an application program running on a smart device.

13. The CCT switchable illuminating device according to claim 10, wherein the control circuit detects a disconnection or connection status of a wall switch forming electrical connection with the CCT switchable illuminating device; and the control circuit implements the selective electrical conduction of the first light-emitting unit group and the second light-emitting unit group with the wall switch when detecting that the wall switch is subjected to one or more on/off operations.

14. The CCT switchable illuminating device according to claim 10, wherein the control circuit implements the selective electrical conduction of the first light-emitting unit group and the second light-emitting unit group based on a signal sent from a Triac dimming driver forming electrical connection with the CCT switchable illuminating device.

15. The CCT switchable illuminating device according to claim 14, wherein the first light-emitting unit is a first CCT LED, and the second light-emitting unit is a second CCT LED.

16. The CCT switchable illuminating device according to claim 1, wherein the first light-emitting unit group comprises at least two first light-emitting units and at least one common unit that are connected in series, and the second light-emitting unit group comprises at least two second light-emitting units and the at least one common unit that are connected in series, wherein the common unit is configured to be in a positive ON status when any of the first light-emitting unit group and the second light-emitting unit group is in the positive ON status.

17. The CCT switchable illuminating device according to claim 16, wherein the first light-emitting unit is a third CCT LED, the second light-emitting unit is a fourth CCT LED, and the common unit is a fifth CCT LED, wherein a fifth CCT is greater than a third CCT and less than a fourth CCT.

18. The CCT switchable illuminating device according to claim 17, wherein the third CCT is 2000K, the fourth CCT is 6500K, and the fifth CCT is 4000K; the CCT of the third CCT LED and the CCT of the fifth CCT LED are mixed to present the first CCT; and the CCT of the fourth CCT LED and the CCT of the fifth CCT LED are mixed to present the second CCT.

19. The CCT switchable illuminating device according to claim 1, wherein the first light-emitting unit group and the second light-emitting unit group are arranged on the same substrate, or the first light-emitting unit group and the second light-emitting unit group are arranged on different substrates respectively.

20. The CCT switchable illuminating device according to claim 1, wherein the number of the filaments is two, four or six, the first light-emitting unit groups of the two, four or six filaments are connected in series, and the second light-emitting unit groups of the two, four or six filaments are connected in series.

* * * * *